United States Patent [19]

Velmin et al.

[11] 4,391,674

[45] Jul. 5, 1983

[54] COKE DELIVERY APPARATUS AND METHOD

[75] Inventors: Rolf Velmin; Michael S. Kovatch, both of Lakewood; Gus H. Mautz, Jr., Westlake, all of Ohio

[73] Assignee: Republic Steel Corporation, Cleveland, Ohio

[21] Appl. No.: 270,529

[22] PCT Filed: Apr. 29, 1980

[86] PCT No.: PCT/US80/00470

§ 371 Date: Feb. 17, 1981

§ 102(e) Date: Feb. 17, 1981

[51] Int. Cl.[3] ..... C10B 33/00; C10B 33/14; C10B 45/02

[52] U.S. Cl. ..... 201/41; 202/262; 202/263; 202/270; 414/210; 414/212; 414/786

[58] Field of Search ..... 201/41; 202/262, 263, 202/270; 414/147, 160, 166, 198, 209, 210, 212, 214–216, 786; 266/157–159

[56] References Cited

U.S. PATENT DOCUMENTS

| | | | |
|---|---|---|---|
| 3,147,837 | 9/1964 | Brotherton . | |
| 3,173,529 | 3/1965 | Hansen . | |
| 3,209,878 | 10/1965 | Harris . | |
| 3,647,636 | 3/1972 | Helm | 202/263 |
| 3,984,289 | 10/1976 | Sustarsic et al. | 202/263 |
| 4,007,093 | 2/1977 | Doilov et al. | 202/262 |
| 4,053,068 | 10/1977 | Gidick | 202/262 |
| 4,106,642 | 8/1978 | Hayduk | 202/262 |
| 4,113,572 | 9/1978 | Manda et al. | 202/263 |
| 4,123,334 | 10/1978 | Emery | 202/262 |
| 4,147,594 | 4/1979 | Cain et al. | 202/263 |
| 4,166,007 | 8/1979 | Becker | 202/262 |
| 4,213,829 | 7/1980 | Friend et al. | 202/262 |

FOREIGN PATENT DOCUMENTS

| | | | |
|---|---|---|---|
| 46-30101 | 9/1971 | Japan | 202/263 |

*Primary Examiner*—Bradley Garris

*Attorney, Agent, or Firm*—Watts, Hoffmann, Fisher & Heinke Co.

[57] ABSTRACT

A coke delivery device 10 includes a swingable chute 16 for guiding coke pushed from a coke oven through a coke rack 12 into a quench car 24.

The chute 16 is drivingly interconnected with a moveable fume hood 14 whereby lowering the fume hood over the quench car positions the chute 16 for coke guiding. Raising the fume hood moves the chute from the coke guiding position to a storage position concurrently spreading coke pushed into the quench car and dumping any coke remaining on the chute into the quench car.

24 Claims, 4 Drawing Figures

COKE DELIVERY APPARATUS AND METHOD

DESCRIPTION

1. Technical Field

This invention relates generally to coke oven batteries, and more specifically to an improved method and apparatus for transferring hot coke from a coke oven chamber into quench cars.

2. Background Art

Coke is produced for iron making by treating coal in batteries of coking ovens. Finished coke is pushed from chambers of an oven along a movable coke rack and into a quench car for transportation to sites of subsequent coke use in the iron making process. The quench cars are moved by a locomotive on tracks alongside the batteries of coke ovens.

Previously, as coke was pushed from an oven chamber, a quench car being loaded would be concurrently driven slowly past the oven chamber thereby distributing the pushed coke within the car. More recently, so called single spot coke cars which remain motionless during a coke push have been utilized to transport coke. Use of these single spot cars has allowed easy and efficient recovery of fumes evolved from the coke during the push, and has resolved past problems in timing the rate of movement of the coke car with the speed of the coke push. Use of the single spot cars has lead to development of devices for distributing coke within the quench car during a coke push.

Coke distributing devices have been proposed which function within the confines of a fume hood lowered over both the distributing device and a hatch through which coke is dropped into the quench car. Typically, such a distribution device forms an extension of the coke rack, and is raised to a storage position following a coke push to provide track clearance for moving the filled quench car. Some prior systems each had a distribution device which acted as a spreader or plow to spread and level the coke within the quench car. With one of these systems the spreading action occurs as the distributor is raised for storage. These distributors have fostered operating difficulties caused by coke remaining within the distributor following a coke push. This remaining coke falls from the distributor into the coke rack as the distributor is raised. This fallen coke from time to time causes mechanical damage to the mechanism used to retract the coke rack from the oven. Additionally, some coke remaining within the distributor may fall over the edge of the quench car to the ground potentially posing environmental problems.

In one commercial system the fume hood and the distribution device are moved to and from the coke guiding positions by separate and independently acting sets of hydraulic cylinders. These multiple cylinders are frequently a source mechanical downtime, delaying the processing of coke.

When the cylinders for raising the hood function properly and raise the hood following a coke push, but the cylinders for raising the distribution device fail to function, movement of the quench car may cause serious mechanical damage to the distribution device. Further, until the distribution device is raised from the quench car, any hatch necessary to seal the quench car for quenching the coke cannot be closed, leading to coke losses through combustion, and posing potential environmental problems.

DISCLOSURE OF INVENTION

The present invention provides an improved method and apparatus for (a) guiding coke pushed from a coke oven chamber into a quench car; (b) distributing the coke within the car; (c) assuring that coke remaining on the distributor following a push is deposited in the quench car; and (d) increasing mechanical reliability of the coke pushing operation.

A device made in accordance with this invention includes a swingable coke guiding chute. During a coke push the chute extends from an opening through which the coke is pushed to a suitable location for guiding the coke into a quench car. Upon completion of the push the chute is swung along a curvilinear pathway from the coke guiding position to a storage position. As the chute is swung any coke remaining on it is dumped into the quench car and concurrently coke within the quench car is distributed.

The swingable chute includes a spreader portion. Following a coke push a driving mechanism swings the chute along the curvilinear path causing the spreader portion to distribute coke within the quench car and concurrently imparting a dumping motion to the chute that deposits any coke remaining on the chute into the quench car.

In a preferred embodiment a coke rack conducts coke pushed from the oven to an opening adjacent the quench car. The swingable chute cooperates with the coke rack, extending from the opening of the rack to a discharge location above the quench car, facilitating both movement of coke to the quench car and distribution of the coke within the quench car.

The swingable chute is positioned within the confines of a moveable fume hood. A positioning mechanism is used to lower the fume hood over the quench car. The swingable chute driving mechanism is connected to the hood so that the lowering motion of the fume hood is used to move and position the swingable chute for coke guiding. Following a coke push, the positioning mechanism is used to raise the fume hood and the connected driving mechanism relocates the swingable chute to the storage position. As the unit moves from the coke guiding to its storage position it travels through a coke spreading range spreading coke within the quench car and dumping residual coke remaining on the chute into the car.

The driving mechanism in a preferred embodiment includes a linkage pivotably attached to the coke rack and drivingly connecting the moveable hood with the swingable chute. A drag linkage interconnects the coke rack and the swingable chute and is in a spaced relationship to the driving linkage. As a hood raising motion drives the chute to the storage portion of the drag linkage restrains motion of the spreader portion of the swingable chute thereby imparting the dumping motion of the chute.

In this invention, powering the swingable chute from motion of the moveable hood eliminates a set of hydraulic cylinders used in prior devices to raise and lower the swingable chute. These cylinders were a source of maintenance aggrevation, and their elimination significantly improves the mechanical reliability of coke pushing operations incorporating this invention. Additionally the likelihood of a malfunction leaving the swingable chute positioned for coke guiding after the moveable hood is raised is eliminated, reducing the opportunity for damage to the swingable chute during movement of quench cars. This interconnected elevation mechanism also eliminates the possibility of coke losses and needless fume escape when the hood is raised but the chute elevation mechanism fails.

The above and other features and advantages of the invention will become apparent from the following detailed description of the invention made with reference to the accompanying drawings which form a part of the specification.

BEST MODE FOR CARRYING OUT THE INVENTION

Figure 1:
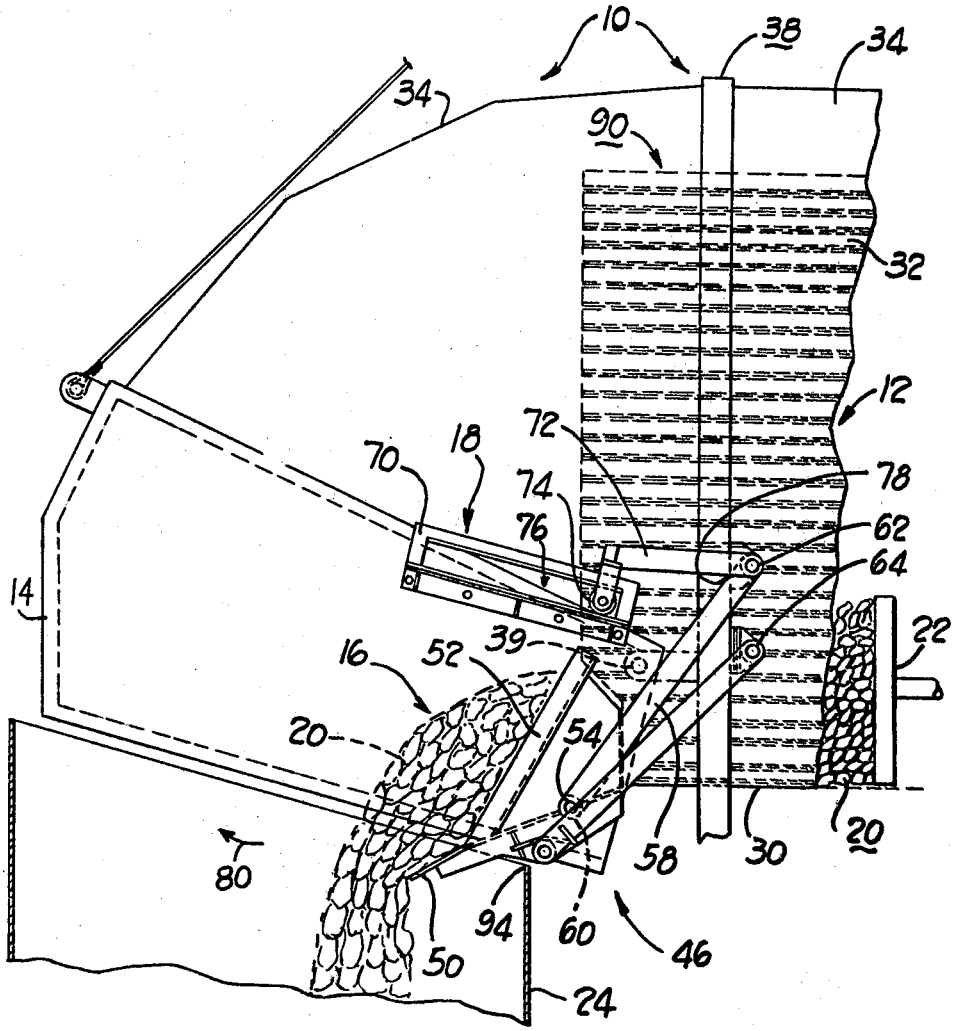
FIG. 1 is a side elevational view of the coke delivery apparatus of this invention positioned for coke guiding.

Referring to FIG. 1, a coke delivery apparatus is shown generally at 10. The apparatus includes a coke rack 12, a moveable hood 14, a swingable coke chute 16, and a mechanism 18 drivingly interconnecting the moveable hood 14 and the chute 16. The apparatus 10 is constructed and arranged to guide coke 20 pushed in any suitable or conventional manner, such as by a pusher 22, from a coke oven chamber (not shown) into a quench car 24.

The coke rack 12 is constructed and arranged to conduct coke 20 from the coke oven to a position adjacent the quench car 24 while capturing and containing fumes evolved from the coke being guided. The rack 12 includes a floor 30 and slatted side panels 32 to guide the coke during the push. The floor 30 and rack side panels 32 are enclosed within a stationary fume hood 34 which captures and contains fumes evolved from the coke. The coke rack terminates at an opening 36 positioned above the quench car 24.

I beams 38, 39 support the coke rack. The I beams are supported by a mechanism (not shown) for translocating the coke rack between coke oven chambers. During a coke push a moveable hood 14 bridges between the opening 36 and the quench car 24 to further contain and capture coke fumes. The moveable hood is attached to the assembly 10 at pivots 39 attached to I beams 38. A cable 40 is attached to the moveable hood at 42. The cable 40 is coupled to a hydraulic cylinder that acts as a prime mover or positioning mechanism. The cable is slackened to allow gravity to position the hood to bridge between the opening 36 and the quench car 24 when coke is being pushed. Following a coke push the prime mover pivotably raises the hood for storage while the quench car 24 is moved.

Coke is guided from the coke rack 12 into the quench car by the swingable chute 16. The chute 16 is moveable from a storage position 44 shown in FIG. 2 to a coke guiding position 46 shown in FIG. 1.

The chute 16 includes a pan like guiding surface 48. With the chute 16 in the coke guiding position 46, the pan extends from the floor 30 of the coke rack 12 to a position over the quench car 24. The pan terminates in a spreader portion 50. Coke guided by the chute 16 is distributed in the quench car 24 as it drops from the spreader 50.

Side portions 52 of the chute perform a dual function, assisting in guiding coke being pushed through the chute and supporting the chute 16. Pivots 54, 56 are attached to the chute side portions 52 and are connected to spaced pairs of arms or links 58, 60. The arms 58, 60 are effectively a paired linkage and are connected to pivots 62, 64 anchored to I beams 38. The arms 58, 60 support the chute 16 within the confines of hood 14. Comparing FIGS. 1 and 2 it may be seen that the arms 58, 60 of each pair constitute a modified or near parallelogram linkage pair. As the chute is raised and lowered the modified parallelogram incorporates a turning or dumping motion to the chute as shown in FIG. 4.

Raising and lowering motion of the hood 14 is transformed or converted by the drive mechanism 18 to raise and lower the swingable chute. The drive mechanism 18 is comprised of a drive guide or cam 70, a power arm or link 72 and a follower or roller 74. The drive guide 70 is attached to the moveable hood and may include a channel or slot 76 in which the follower 74 rides.

The power arm 72 connects the follower 74 with the pivot 62. The angle 78 between power arm 72 and arm 58 is fixed. Motion of the follower 74 in the slot 76 during a raising of the hood 14 is transferred through the power arm 72, pivot 62 and arm 58 to impart translational motion along a curvilinear path to pivot 54 as shown in phantom in FIG. 4.

Figure 4:
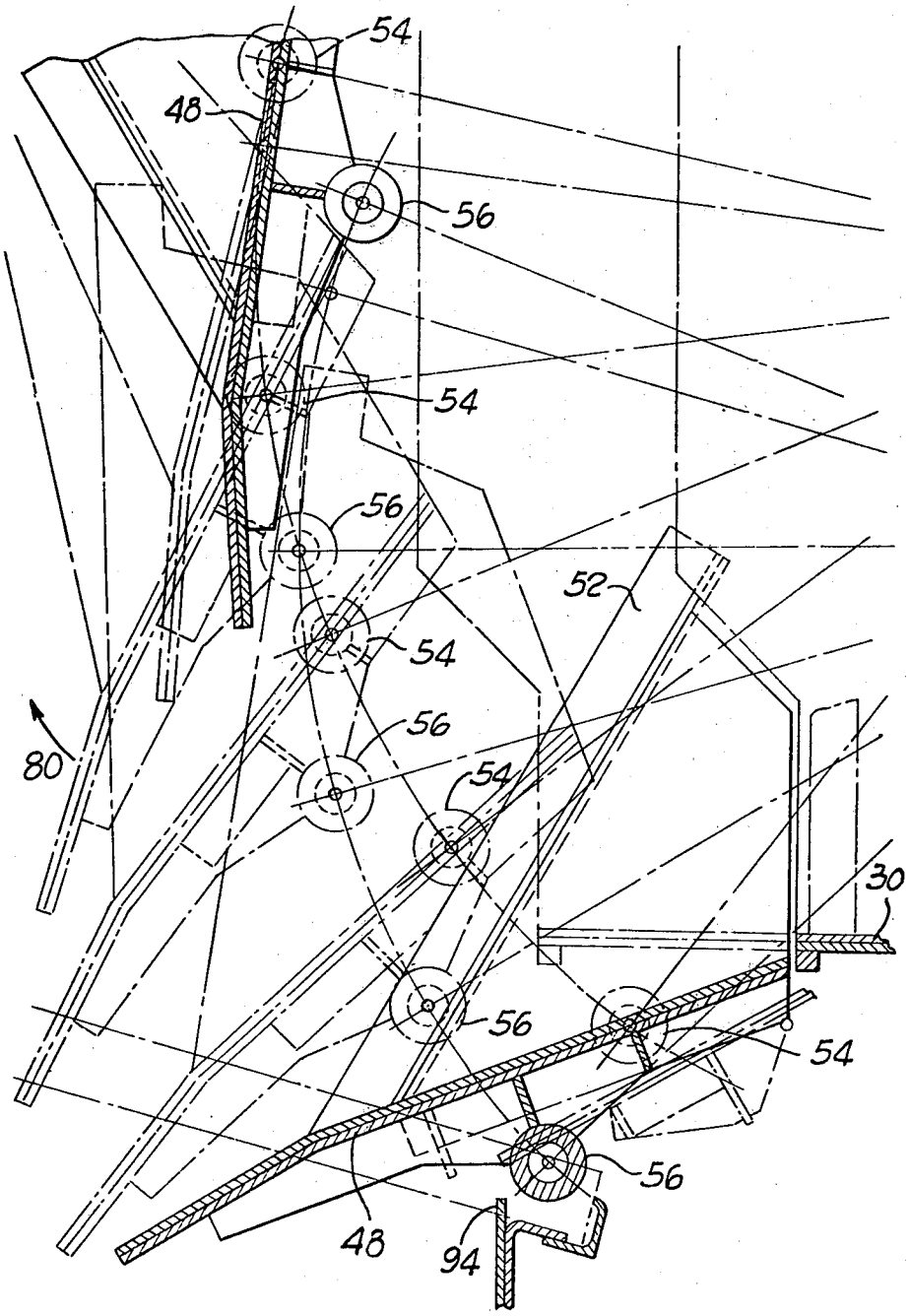
FIG. 4 is a sequential representation in phantom of a curvilinear path taken by the coke chute of this invention in moving from a coke guiding position to a storage position and visa versa.

It may be seen from FIG. 4 that initial motion along the curvilinear path causes spreader 50 to plow any mounded coke in a direction away from the coke rack 12 and floor 30, as shown generally at 80. Concurrently, the arm 60 acts as a drag link to retard the motion of pivot 56 thereby imparting a dumping motion to the chute pan 48 that deposits any coke remaining on the pan 48 in the quench car 24 as the pan moves in a direction away from the coke rack 12.

The coke pushing process between a coke oven chamber and a prepositioned quench car 24 through a prepositioned coke rack is begun by lowering the moveable hood 14 to bridge between the opening 36 and the quench car. The drive mechanism 18 concurrently positions the swingable coke chute 16 to extend from the floor 30 to a position suitable for depositing coke in the quench car. Coke is then pushed from the oven.

Upon completion of the push the moveable hood 14 is raised and the driving mechanism concurrently drives the swingable chute towards its storage position 44. The spreader portion 50 of the chute 16 plows any mounded coke away from the rack 12 and any coke remaining on the chute 16 is dumped into the car not back into the rack 12 as was the case with certain prior mechanisms.

Figure 2:
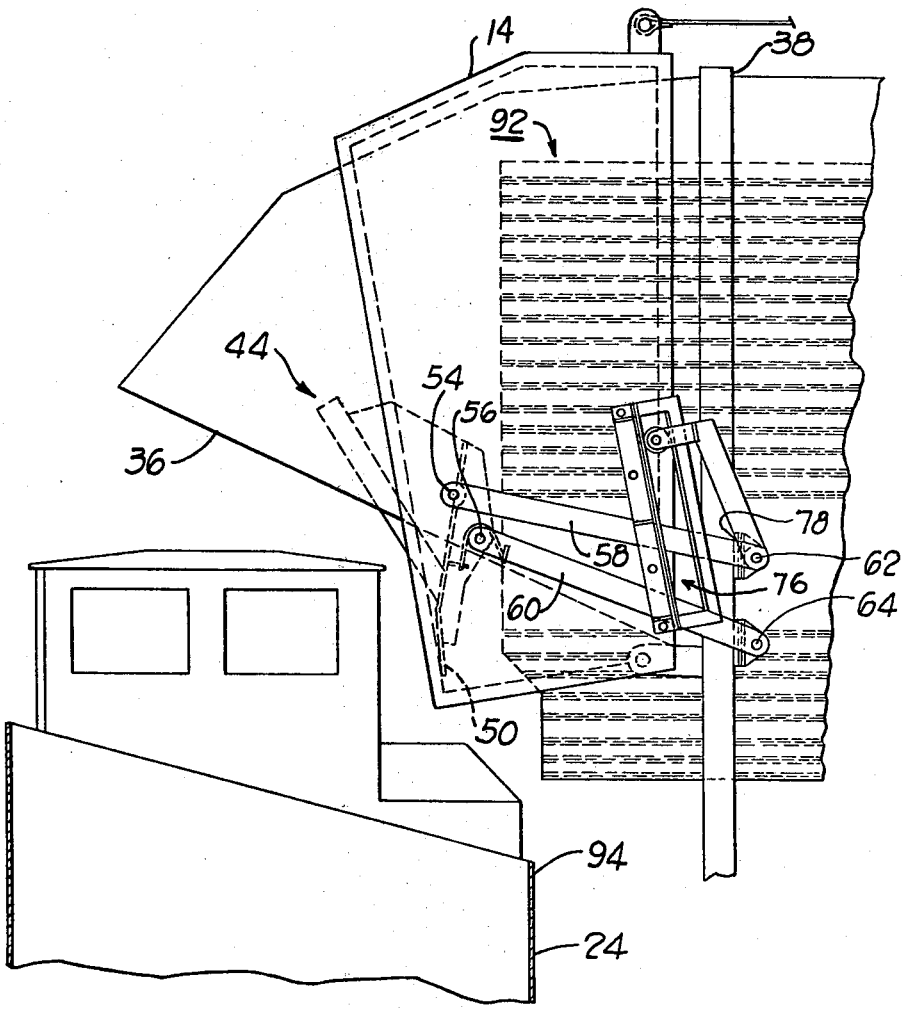
FIG. 2 is a side elevational view of the apparatus of FIG. 1 positioned in its storage position.
Figure 3:
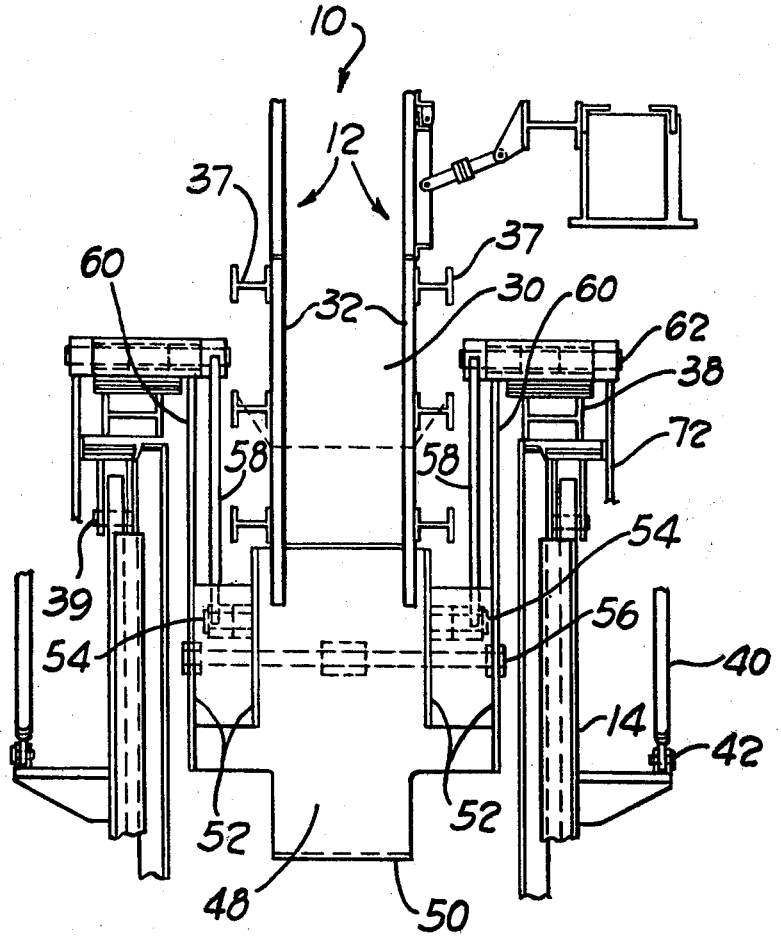
FIG. 3 is a frontal view of the apparatus of this invention on a reduced scale and with the hood cutaway.

The rack 12 may then be withdrawn from a coke pushing position 90 as shown in FIG. 1 to a rack transportation position 92 as shown in FIG. 2 with substantially reduced probability that coke remaining on the chute 16 will jamb mechanisms (not shown) used to withdraw the rack. In addition, the likelihood of coke falling from the quench car over an edge 94 is substantially reduced by dint of the coke having been distributed by the spreader 50 within the quench car and coke remaining on the chute 16 having been dumped into the car away from both the rack 12 and the edge 94.

While a preferred embodiment of the invention has been described in detail, it will be apparent that various modifications or alterations may be made therein without departing from the spirit and scope of the invention as set forth in the appended claims.

We claim:

1. A coke delivery apparatus for use in the transfer of coke from a coke oven to a quench car comprising;

(a) a movable hood structure adapted for movement when in use from a fume confining coke delivery position to a storage position and return;

(b) a chute structure adapted when in use to be moved from a coke guiding position to a storage position and return, said chute structure having a guiding portion for contacting and guiding the coke; and, (c) a force transmitting structure interconnection assembly operably connected to each of the structures and adapted to transmit motion producing forces from one structure to the other when the one structure is driven from one of its said positions to the other, the motion of said chute structure in moving toward its storage position having both rotational and translational components which dispose said guiding portion in a position facing away from the coke oven.

2. The apparatus of claim 1 wherein the chute structure includes a mechanism to cause said guiding portion of the chute structure to move along a curvilinear path to produce both coke spreading and dumping action when the chute structure is moved from its coke guiding to its storage position.

3. The apparatus of claim 1 wherein the chute structure includes the spaced pairs of links and wherein the links of each pair are of different effective lengths.

4. A chute assembly for use in filling a receptacle with coke comprising:

(a) a chute including a coke quenching and spreading surface portion and an adjacent coke contacting and guiding surface portion;

(b) first and second pairs of links respectively pivotally connected to the chute near opposite ends of the surface portions;

(c) each of the links having a second pivot spaced from its chute pivot; and, (d) the space between the pivots of a first link of each pair being greater than the space between the pivots of the second link of each pair, said links and pivots being arranged and constructed so that, when said chute is pivoted away from the receptacle, said coke contacting and guiding surface portion is moved into a position facing toward the receptacle.

5. The assembly of claim 4 wherein the first link of each pair is mounted above its paired link when the assembly is in use.

6. A mechanism for use in combination with a coke oven and a quench car in the transfer of coke from the oven to the car comprising:

(a) a movable hood structure mounted for movement from a storage position to a coke delivery position and return;

(b) the hood structure having surfaces defining a coke discharge aperture positioned to permit coke to be delivered to a quench car when the hood structure is in its coke delivery position;

(c) a guide chute adapted to move from a coke guiding position through a coke spreading range to a storage position;

(d) the chute structure including coke guiding surfaces forming an inclined ramp for contacting and guiding coke pushed from an oven to a quench car when the chute structure is in the coke guiding position;

(e) a structure interconnecting linkage connected to each of the structures and adapted to drive one of the structures from one of its positions to the other when the other of the structures is moved from one of its positions to the other; and, (f) structure drive means operably connected to the other of the structures to move the other structure in a compound fashion from one of its positions to the other and return, said linkage and drive means being arranged and constructed to dispose said ramp in a position facing away from the coke oven when said chute structure is moved toward its storage position.

7. The mechanism of claim 6 wherein the interconnecting linkage includes:

(a) a cam connected to one of the structures and a cam follower connected to the other of the structures; and wherein, (b) the other structure is the movable hood structure.

8. The mechanism of claim 6 wherein guide chute structure includes means to cause the coke guiding surfaces to traverse a curvilinear path to affect both coke spreading action and dumping of coke from the chute structure when the chute structure is moved from its guiding to its storage position.

9. A mechanism for use in combination with a coke oven and a quench car in the transfer of coke from the oven to the car comprising:

(a) a multi-sectioned hood having at least one section that is movable from a storage position to a coke delivery position and return;

(b) the one section having surfaces defining a coke discharge aperture positioned to permit coke to be delivered to a quench car when the one section is in its coke delivery position;

(c) a guide chute structure adapted to move in a compound motion from a coke guiding position through a coke spreading range to a storage position;

(d) the chute structure including coke guiding surfaces forming an inclined ramp for contacting and guiding pushed coke downwardly and outwardly from an oven to a quench car when the chute structure is in the coke guiding position;

(e) at least two pairs of chute support links each pivotally connected near one of its ends to support structure and each pivotally connected near another end to the chute structure; and, (f) chute drive means operably connected to the chute structure and links to move the chute structure from its coke guiding position through its coke spreading range to the chute structure storage position, said links and drive means being arranged and constructed to dispose said ramp in a position facing away from the coke oven when said chute structure is moved toward its storage position.

10. The mechanism of claim 9 wherein the chute structure and links form a near parallelogram system and wherein the chute drive means includes:

(a) a cam connected to a selected one of the movable hood section and the system and a cam follower connected to the other of the movable hood section and the system; and, (b) a prime mover operably connected to a component of the movable hood section or the system whereby activation of the prime mover causes movement of both the movable hood section and the system.

11. The mechanism of claim 9 wherein the links of each pair are upper and lower links and the distance between the axes of the upper link pivots is greater than the distance between the axes of the lower link pivots whereby to cause curvilinear motion of a point on the guide chute structure, through said spreading range when it is moved from its coke guiding to its storage position.

12. An apparatus for transferring coke from a coke oven chamber into a receptacle near the oven chamber including:

(a) fume recovery means including a movable hood for recovering coke fumes from the transfer apparatus and the receptacle;

(b) positioning means operably connected to the hood for raising and lowering the movable hood;

(c) coke guiding means, including a swingable chute having a spreader portion, for guiding coke into the receptacle wherein residual coke remains on the swingable chute following completion of a coke transfer and;

(d) driving means for imparting coke spreading motion to the spreader portion and concurrently coke dumping motion to the swingable chute, said driving means being arranged and constructed to dispose the coke contacting portion of said chute in a position facing away from said coke oven chamber while imparting said spreading and dumping motions, whereby upon completion of a coke transfer, the swingable chute is driven in a direction away from the coke oven chamber to dump the residual coke into the receptacle and the spreader portion is driven in a direction away from the coke oven chamber to spread coke within the receptacle.

13. An apparatus for transferring coke from a coke oven chamber into a receptacle near the oven chamber including:

(a) means including a movable hood for recovering coke fumes from the transfer apparatus and the receptacle;

(b) positioning means for raising and lowering the movable hood;

(c) coke guiding means, including a swingable chute having a spreader portion, for guiding coke into the receptacle, wherein residual coke remains on the swingable chute following completion of a coke transfer; the movable hood generally surrounding and connected in driving relationship to the swingable chute, including means for imparting a swinging motion, away from the receptacle, to said swingable chute and for disposing the coke contacting portion of the chute in a position facing away from said coke oven chamber while imparting said swinging motion, whereby upon completion of a coke transfer, the swingable chute during swinging motion is also driven in a translational direction away from the coke oven chamber to dump the residual coke into the receptacle.

14. An apparatus including a swingable chute having a spreader portion for guiding coke being pushed from a coke oven chamber into a receptacle near the oven chamber, and wherein residual coke will remain on the swingable chute after a push, the improvement comprising:

(a) driving means for imparting coke spreading motion to the spreader portion and concurrently coke dumping compound motion to the swingable chute, said driving means being arranged and contructed to dispose the coke contacting portion of said chute in a position facing away from said coke oven chamber while imparting said spreading and dumping motions, whereby, upon completion of a coke push the swingable chute is driven in a direction away from the coke oven chamber to deposit the residual coke in the receptacle and the spreader portion is driven in a direction away from said coke oven chamber to spread coke within the receptacle.

15. The apparatus of claim 14 wherein the driving means includes a movable fume hood generally surrounding and connected in driving relationship to the swingable chute for moving the chute when the hood is raised and lowered.

16. An apparatus for transferring coke pushed from an oven chamber through an opening in a coke rack into a quench car comprising:

(a) a movable hood structure for capturing coke fumes from the rack and quench car;

(b) drive means operably connected to the hood structure for raising and lowering the hood structure;

(c) a swingable chute structure having both an upper portion and a spreader portion whereon residual coke may remain following a coke push;

(d) a swingable chute structure drive mechanism including:

(i) a slotted drive guide connected to one of the structures; and (ii) a drive link pivotably connected to the other structure and connected to the drive guide slot in relatively movable relationship;

(e) the chute structure including a chute and a pair of chute support links each pivotably connected to the chute and to the rack;

(f) the chute being movable between a coke guiding position extending from the opening to a location suitable for discharging coke into the quench car, and a storage position;

(g) the drive mechanism being adapted to transform driving motion of one structure to move the other structure and being arranged and contructed to dispose said upper and spreader portions in a position facing away from said oven chamber while said chute is being moved toward its storage position; and, (h) the motion of the chute from the guiding position to the storage position being along a curvilinear path whereby when in use the spreader portion will distribute coke within the quench car, while concurrently dumping residual coal remaining on the chute into the car.

17. An apparatus for transferring coke pushed from an oven chamber through an opening in a coke rack into a quench car comprising:

(a) means including a movable hood for capturing coke fumes from the rack and quench car;

(b) means for raising and lowering the movable hood;

(c) a swingable chute having both an upper portion and a spreader portion whereon residual coke may remain following a coke push;

(d) a swingable chute drive mechanism including:

(i) a slotted drive guide attached to the movable hood;

(ii) a drive linkage pivotably connected to the swingable chute and connected to the drive guide slot in relatively movable relationship, the drive linkage being pivotably attached to the coke rack; and, (iii) a restraining linkage pivotably connecting the rack and the swingable chute in spaced vertical relationship to the drive linkage;

(e) the swingable chute being movable between a coke guiding position extending from the opening to a location suitable for discharging coke into the quench car, and a storage position; and, (f) the drive mechanism being adapted to transform a raising motion of the movable hood to move the swingable chute from the guiding position to the storage position along a curvilinear path and being arranged and constructed to dispose said upper and spreader portions in a position facing away from said oven chamber while said chute is being moved toward its storage position whereby when in use the spreader portion will distribute coke within the quench car, concurrently residual coke remaining on the swingable chute is dumped in a direction of a swingable chute motion.

18. In a process wherein coke being pushed from a coke oven chamber is guided into a receptacle by a swingable chute, a spreader portion of the swingable chute spreading the coke within the receptacle following a coke push, and wherein residual coke will remain on the swingable chute, the improvement comprising the step of:

dumping residual coke from the swingable chute into the receptacle while spreading coke within the receptacle by simultaneously translating and rotating the swingable chute so as to dispose the coke contacting portion of said chute in a position facing away from said coke oven chamber.

19. A method for guiding coke pushed from a coke oven chamber through a discharge opening to drop into a quench car including the steps of:

(a) positioning a chute in a coke guiding position extending from the discharge opening to a position over the quench car before coke is pushed through the opening;

(b) pushing a quantity of coke from the oven; and, (c) pivotally swinging the chute along a curvilinear path from its coke guiding position to a storage position and simultaneously translating the chute relative to said chamber so as to dispose the coke contacting portion of said chute in a position facing away from said coke oven chamber.

20. A method for guiding coke pushed from a coke oven chamber through an opening to drop into a quench car including the steps of:

(a) lowering a fume hood while the hood causes a drivingly connected swingable chute to move to a coke guiding position extending from the opening to a location over the quench car;

(b) pushing a quantity of coke from the oven chamber through the opening to cause coke to travel over the chute;

(c) capturing fumes released by the coke during the push;

(d) raising the fume hood to move the swingable chute in a compound fashion from the coke guiding position to a storage position so as to dispose the coke contacting portion of said chute in a position facing away from said coke oven chamber thereby dumping coke remaining on the swingable chute into the quench car and concurrently spreading coke in the quench car with a spreader portion of the swingable chute.

21. A method for guiding a transfer of coke through an opening to drop into a receptacle including the steps of:

(a) positioning a swingable chute in a coke guiding position extending from the opening to a position for dropping coke into the receptacle;

(b) transferring the coke; and (c) swinging the chute along a compound path to a storage position so as to dispose the coke contacting portion of said chute in a position facing toward said receptacle thereby dumping coke remaining on the chute into the receptacle and concurrently spreading coke in the receptacle by both rotation and translational motion.

22. Apparatus for guiding coke pushed from a coke oven to a quench car, said apparatus comprising:

(a) a coke chute for extending between the oven and the car, and (b) structure for movably mounting the chute, said mounting structure constraining at least a portion of the chute for simultaneous translational and rotational motion away from the car, and being arranged and constructed to dispose the coke contacting portion of said chute in a position facing away from the coke oven during said motion, for dumping residual coke from the chute and rearranging coke in the quench car.

23. Apparatus for guiding coke pushed from a coke oven chamber through an opening to drop into a quench car, said apparatus comprising:

(a) a fume hood;

(b) a swingably mounted chute adapted for movement to a coke guiding position extending from the opening to a location over the quench car;

(c) apparatus for mounting the fume hood for raising and lowering motion;

(d) apparatus coupled between the fume hood and the swingable chute for driving the swingable chute to said coke guiding position in response to lowering of the fume hood;

(e) apparatus for pushing a quantity of coke from the oven chamber through the opening to cause coke to travel over the chute, while fumes rising from the coke are captured in the fume hood;

(f) said driving apparatus comprising means for moving the swingable chute in a compound motion from a coke guiding position to a storage position in response to raising of the fume hood, said compound motion defined by said moving means for causing a portion of said chute, during said motion, to contact and spread coke within the quench car, and said moving means being arranged and constructed to dispose the coke contacting portion of said chute in a position facing away from the coke oven chamber while said chute is moving toward its storage position.

24. Apparatus for guiding a transfer of coke through an opening to drop into a receptacle, said apparatus comprising:

(a) a chute mounted for movement to a coke guiding position wherein the chute extends from the opening to a location suitable for dropping coke from the chute into the receptacle;

(b) apparatus for discharging coke into the chute, and (c) movable support apparatus for mounting said chute for compound movement along a path between the coke guiding position and a storage position, said path being defined by said movable support apparatus for facilitating contact of a portion of the chute with coke in the receptacle during movement in order to spread coke in the receptacle, said movable support apparatus being arranged and constructed to dispose the coke contacting portion of said chute in a position facing toward said receptacle while said chute is moving toward its storage position.

* * * * *